US009067723B2

(12) United States Patent
Chang et al.

(10) Patent No.: US 9,067,723 B2
(45) Date of Patent: Jun. 30, 2015

(54) CONTAINER FOR STORING FOODS

(71) Applicants: Wan Ching Chang, Taichung (TW); Han Tsung Chen, Taichung (TW); Wei Fu Chen, Taichung (TW)

(72) Inventors: Wan Ching Chang, Taichung (TW); Han Tsung Chen, Taichung (TW); Wei Fu Chen, Taichung (TW)

( * ) Notice: Subject to any disclaimer, the term of this patent is extended or adjusted under 35 U.S.C. 154(b) by 31 days.

(21) Appl. No.: 14/160,588

(22) Filed: Jan. 22, 2014

(65) Prior Publication Data

US 2014/0131354 A1 May 15, 2014

(51) Int. Cl.
*B65D 85/72* (2006.01)
*B65D 81/20* (2006.01)
*B65D 1/40* (2006.01)

(52) U.S. Cl.
CPC ..... *B65D 81/2038* (2013.01); *B65D 1/40* (2013.01); *B65D 85/72* (2013.01)

(58) Field of Classification Search
CPC ..... B65D 1/40; B65D 85/72; B65D 81/2038
USPC ..... 220/666, 367.1, 89.1, 366.1, 231, 220/203.07; 215/900, 381, 382, 262; 141/65
See application file for complete search history.

(56) References Cited

U.S. PATENT DOCUMENTS

2004/0040972 A1* 3/2004 Haj ..... 220/666
2009/0230012 A1* 9/2009 Choy et al. ..... 206/524.8
2013/0168401 A1* 7/2013 Avairis ..... 220/666

* cited by examiner

*Primary Examiner* — Fenn Mathew
*Assistant Examiner* — Elizabeth Volz

(57) ABSTRACT

A container for storing food is provided with a receptacle including a bellows, a top opening, and external threads around the opening; and a lid including a skirt including internal threads secured to the external threads, a top bossed hole communicating with the bellows, and a top frame having an n-shaped section, the frame including an inner slot; an inlet valve in the bossed hole; a trigger assembly including a spring loaded piston in the frame, and a trigger formed with the piston; a sealing ring secured to an end of the piston distal the trigger; a cylinder for receipt of the sealing ring and a portion of the piston, an inlet port fitted on the bossed hole, and an outlet valve at an end distal the sealing ring; and a cover including a peripheral opening for receipt of the trigger.

1 Claim, 9 Drawing Sheets

CONTAINER FOR STORING FOODS

BACKGROUND OF THE INVENTION

1. Field of the Invention

The invention relates to household food storage containers and more particularly to an airtight container for storing foods for a prolonged period of time.

2. Description of Related Art

Food storage containers for household use are well known. They are conventionally formed of plastic. The container includes a receptacle for storing foods, and a lid for opening or closing the receptacle.

A conventional container for storing foods is comprised of a receptacle having an opening; a packing ring abutting the opening; a plurality of flared passages penetrating the packing ring and connecting inside of the receptacle to outside of the receptacle through an orifice, the passage being flared toward inside of the receptacle; a cover configured to airtightly close the receptacle, the cover having a bottom, an annular rib projecting from the bottom for mating with an inner surface of the packing ring, a peripheral outside edge for coming over a corresponding edge of the packing ring to mate with an outer surface of the packing ring, the peripheral outside edge also capping the orifice of the flared passage; and a sealing element corresponding to the flared passages, the sealing element adapted to come into the flared passages and seal it when the cover is mounted on the receptacle.

While it has some utility, improvements in these products are desired, and these improvements are provided by the invention.

SUMMARY OF THE INVENTION

It is therefore one object of the invention to provide a food storage container comprising a receptacle comprising a bellows, an opening at one end, and external threads around the opening; and a lid comprising a peripheral skirt including internal threads secured to the external threads, a bossed hole on a top communicating with the bellows, and a frame on a top, the frame having an n-shaped section, the frame including an inner slot; an inlet valve disposed in the bossed hole; a trigger assembly including a spring loaded piston disposed in the frame, and a trigger formed with the spring loaded piston; a sealing ring secured to an end of the spring loaded piston distal the trigger; a cylinder for receipt of the sealing ring and a portion of the spring loaded piston, an inlet port fitted on the bossed hole, and an outlet valve at an end distal the sealing ring; and a cover including a peripheral opening for receipt of the trigger; wherein both the inlet and outlet valves are closed in an inoperative position; wherein a pushing of the trigger moves the spring loaded piston further into the cylinder to expel air out of the cylinder via the outlet valve; wherein after releasing the trigger, the trigger is pushed outward to its inoperative position by moving the spring loaded piston to its inoperative position, thereby drawing air from the bellows into the cylinder with the outlet valve being closed; and wherein in response to pushing down the cover, the bellows is compressed, thereby drawing air from the bellows into the cylinder, and expelling air out of the cylinder via the outlet valve.

The above and other objects, features and advantages of the invention will become apparent from the following detailed description taken with the accompanying drawings.

DETAILED DESCRIPTION OF THE INVENTION

Figure 1:
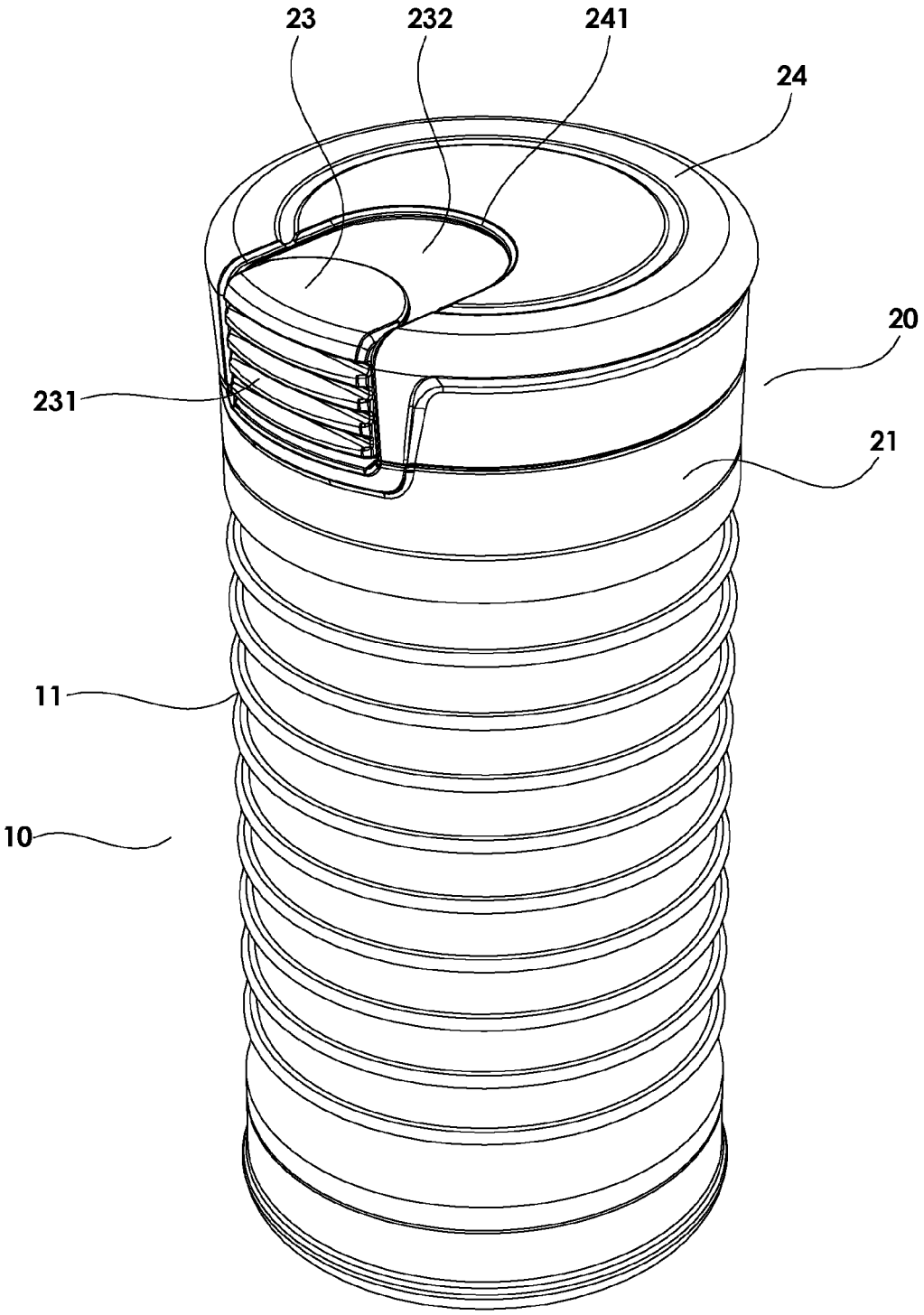
FIG. 1 is a perspective view of a container for storing foods according to the invention.
Figure 2:
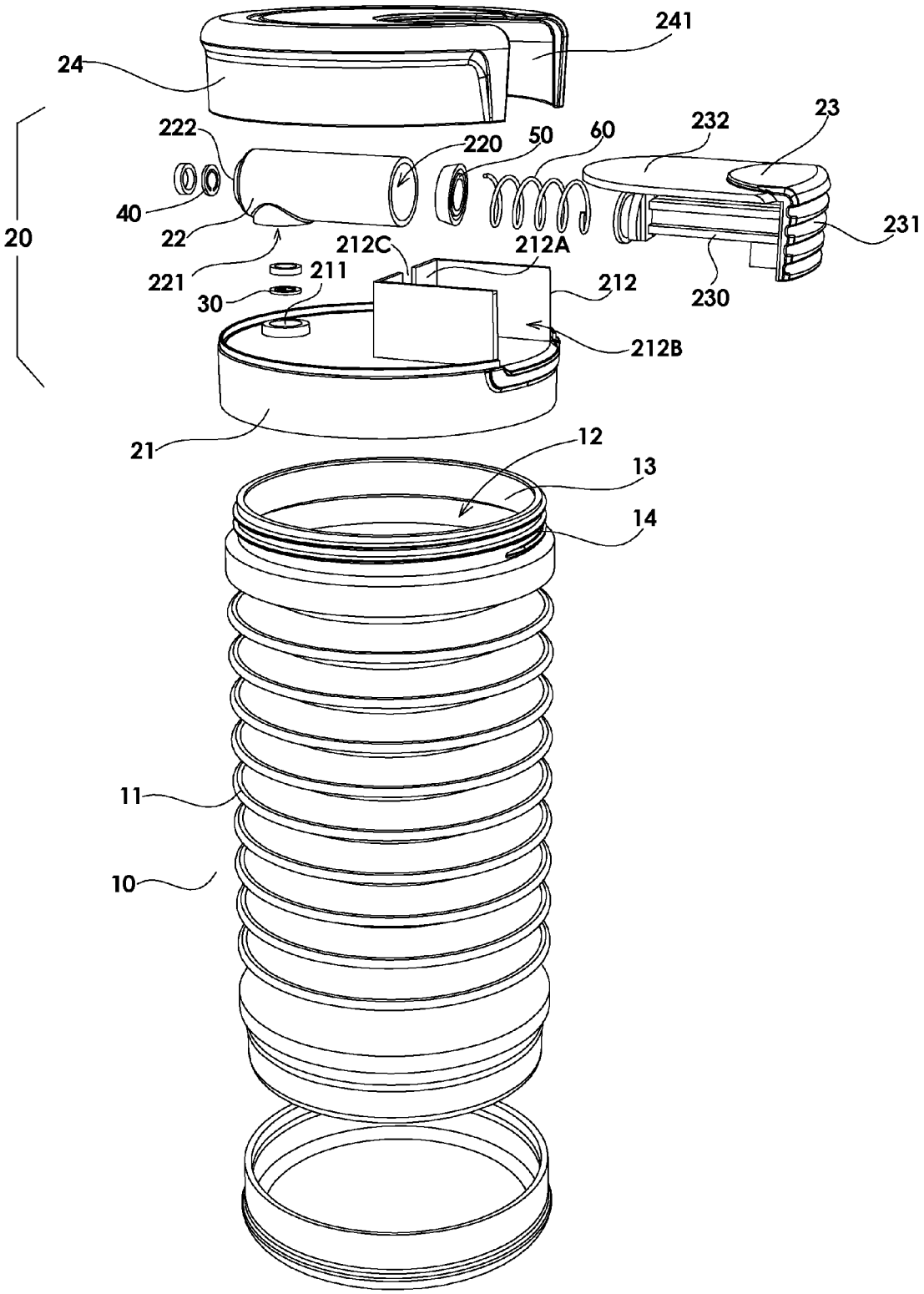
FIG. 2 is an exploded view of the container.
Figure 3:
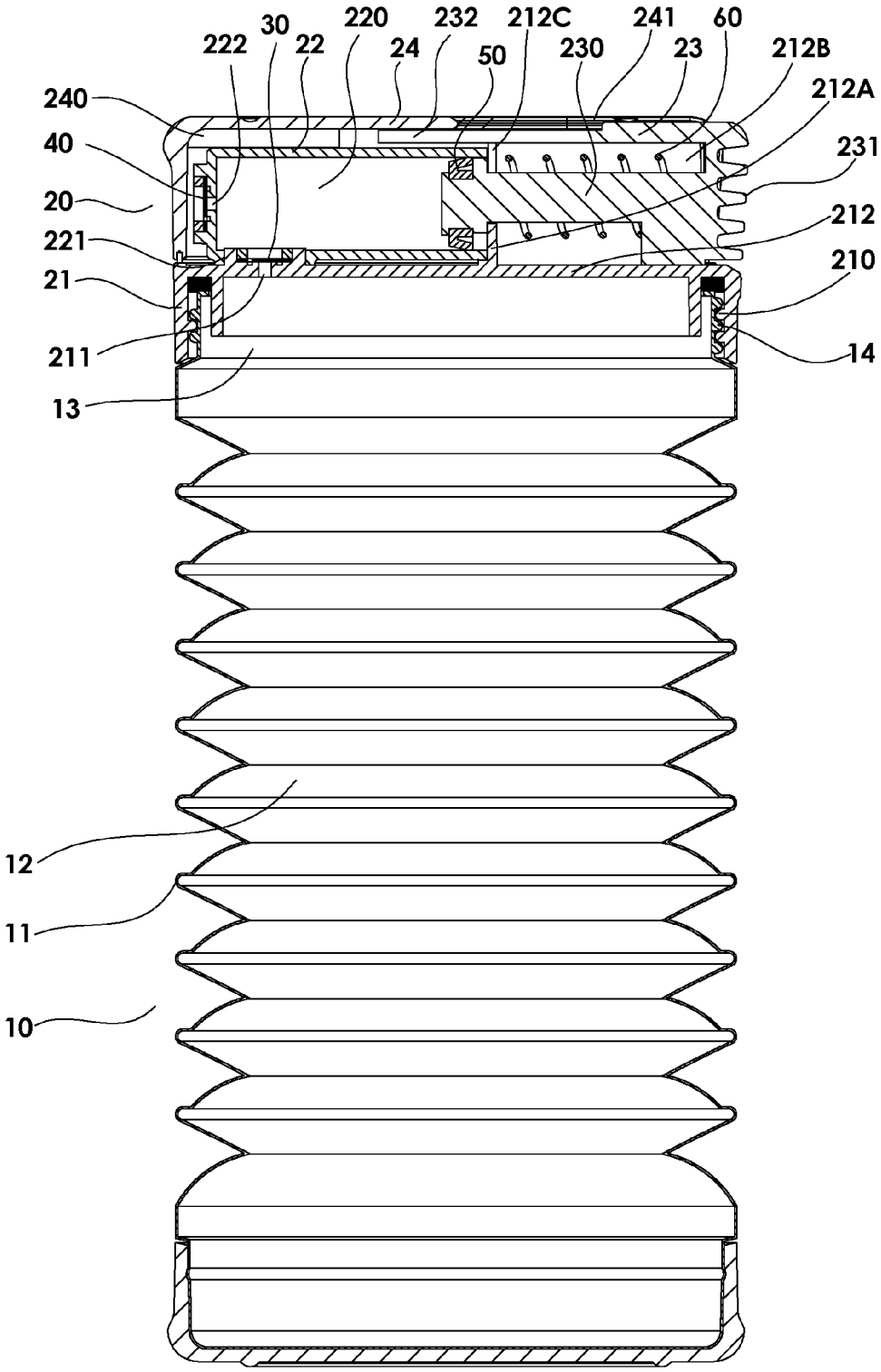
FIG. 3 is a longitudinal sectional view of the container of FIG. 1.
Figure 4:
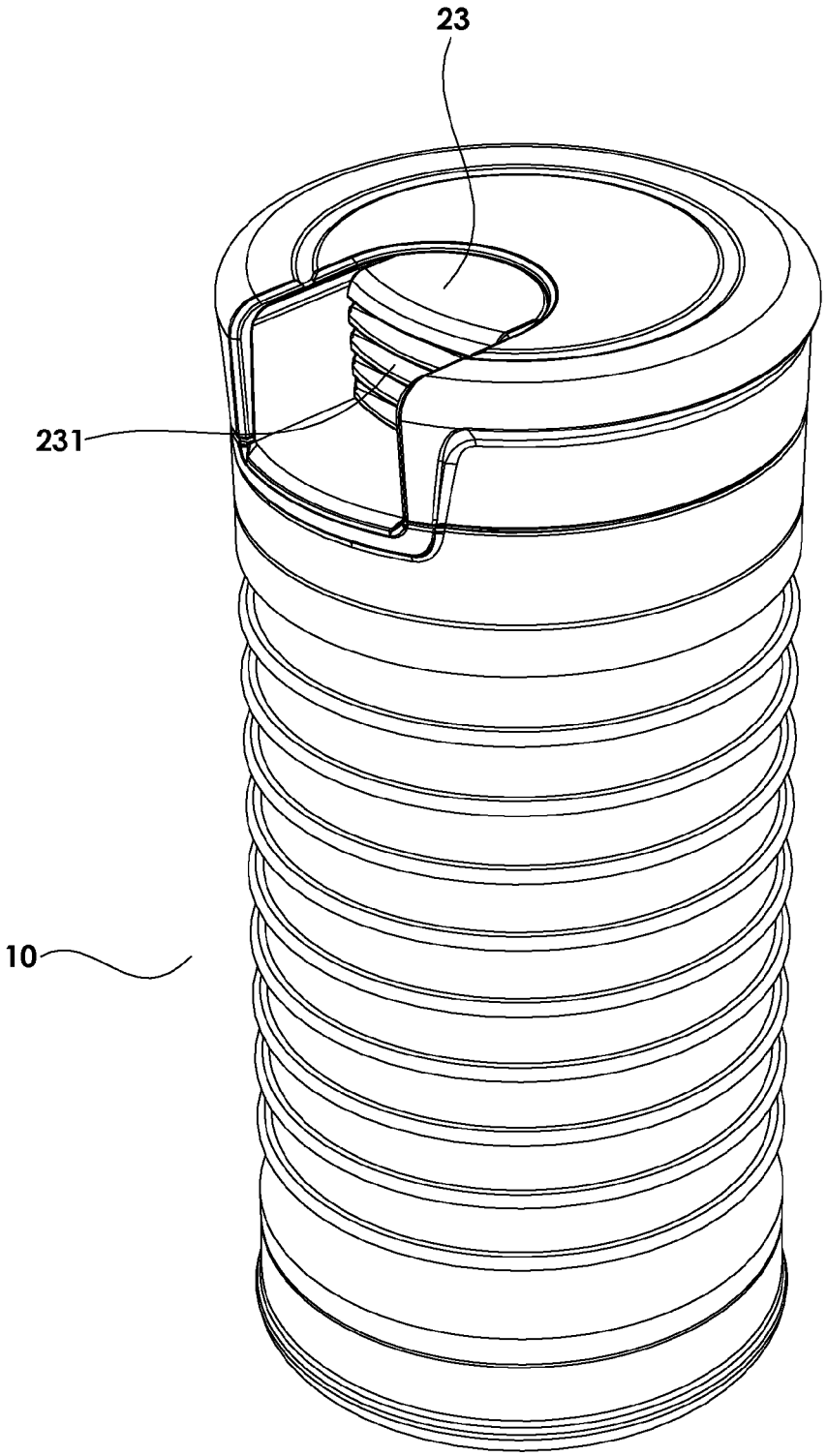
FIG. 4 is a view similar to FIG. 1 showing the pressed trigger.

Referring to FIGS. 1 to 7B, a container for storing foods in accordance with the invention comprises the following components as discussed in detail below.

A receptacle 10 is made of resilient material and comprises a cylindrical bellows 11 including an interior 12, a top opening 13, and external threads 14 around the opening 13. A lid 20 comprises a peripheral skirt 21 including internal threads 210 on an inner surface adapted to secure to the threads 14, a top bossed hole 211 adjacent to the edge, and a top frame 212 having an n-shaped section, the frame 212 including a space 212B, an inner wall 212A opposite to its opening, and a slot 212C formed on the inner wall 212A. An inlet valve 30 is disposed in the bossed hole 211.

The lid 20 further comprises a trigger assembly 23 including a piston 230 in the space 212B, an outer trigger 231, and a top panel 232 parallel to the piston 230. A helical spring 60 is put on the piston 230 and is biased between the trigger 231 and the inner wall 212A. A flexible sealing ring 50 is secured to an inner end of the piston 230 proximate to the inner wall 212A and distal the trigger 231. The lid 20 further comprises a cylinder 22 including a space 220 for accommodating both the sealing ring 50 and the piston 230, a bottom inlet port 221 fitted on the bossed hole 211, and an exit 222 at an end distal the sealing ring 50. An outlet valve 40 is disposed in the exit 22.

The lid 20 further comprises a C-shaped cover 24 including a peripheral opening 241 for accommodating the trigger assembly 23, and a space 240 defined between a top of the cover 24 and the top of the skirt 21. In an inoperative position, the trigger 231, the skirt 21, and the peripheral surface of the cover 24 form a circular surface; the spring 60 is fully expanded, the sealing ring 50 is proximate the inner wall 212A, and both the inlet and outlet valves 30, 40 are closed (see FIG. 3).

Figure 5A:
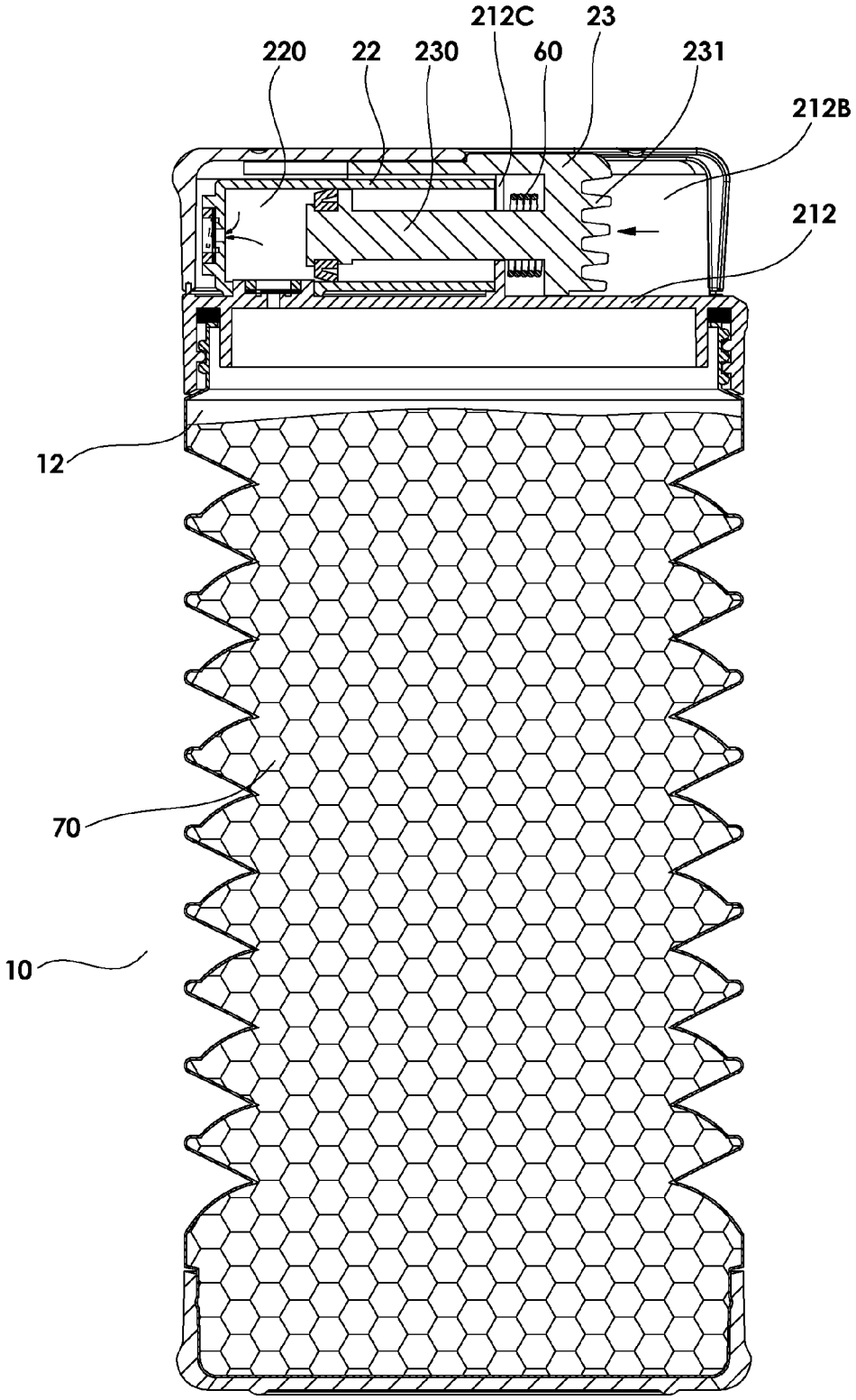
FIG. 5A is a longitudinal sectional view of the container of FIG. 4 showing the trigger being pressed to expel air out of the cylinder via the open outlet valve.
Figure 5B:
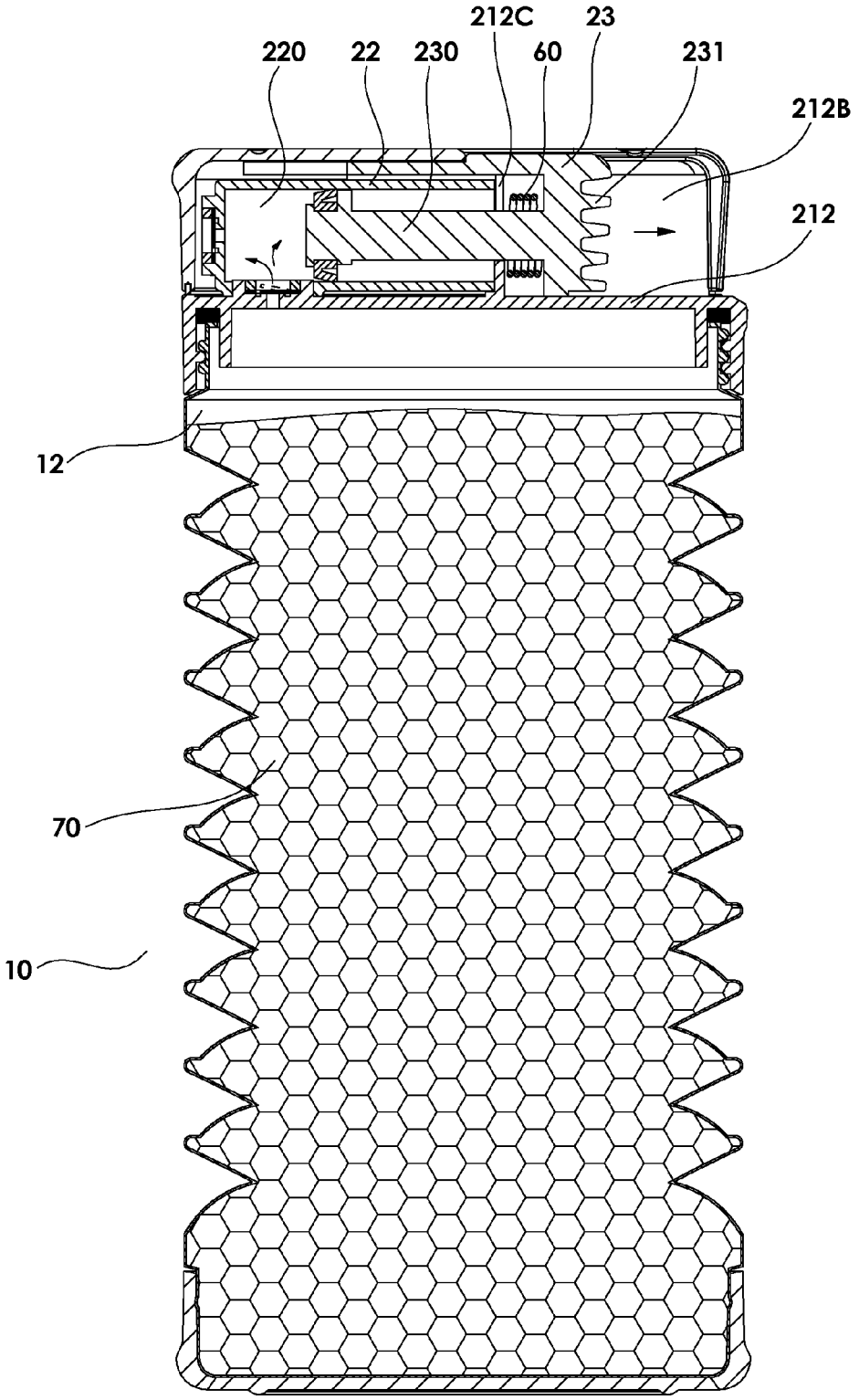
FIG. 5B is a view similar to FIG. 5A showing the trigger being pushed outward to draw air from the receptacle into the cylinder via the open inlet valve.

As shown in FIG. 5A, after storing an item of food 70 in the interior 12, an individual may push the trigger 231 to move the piston 230 further into the cylinder 22 until the trigger 231 is stopped by the top edge of the opening 241. The movement of the piston 230 can expel air out of the space 220 via the outlet valve 40 with the spring 60 being compressed (i.e., the space 220 being near vacuum). As shown in FIG. 5B, after releasing the trigger 231, the energized spring 60 pushes the trigger 231 outward to its original position by moving the piston 230 in an opposite direction. Air is thus drawn from the interior 12 into the near vacuum space 220 with the outlet valve 40 being closed because atmospheric pressure externally of the cylinder 22 is greater than that of the space 220. Repeated (i.e., reciprocating operations) of FIGS. 5A and 5B can expel most air including moisture out of the interior 12 (i.e., being near vacuum), thereby capable of preserving the item of food 70 to a prolonged period of time.

Figure 6:
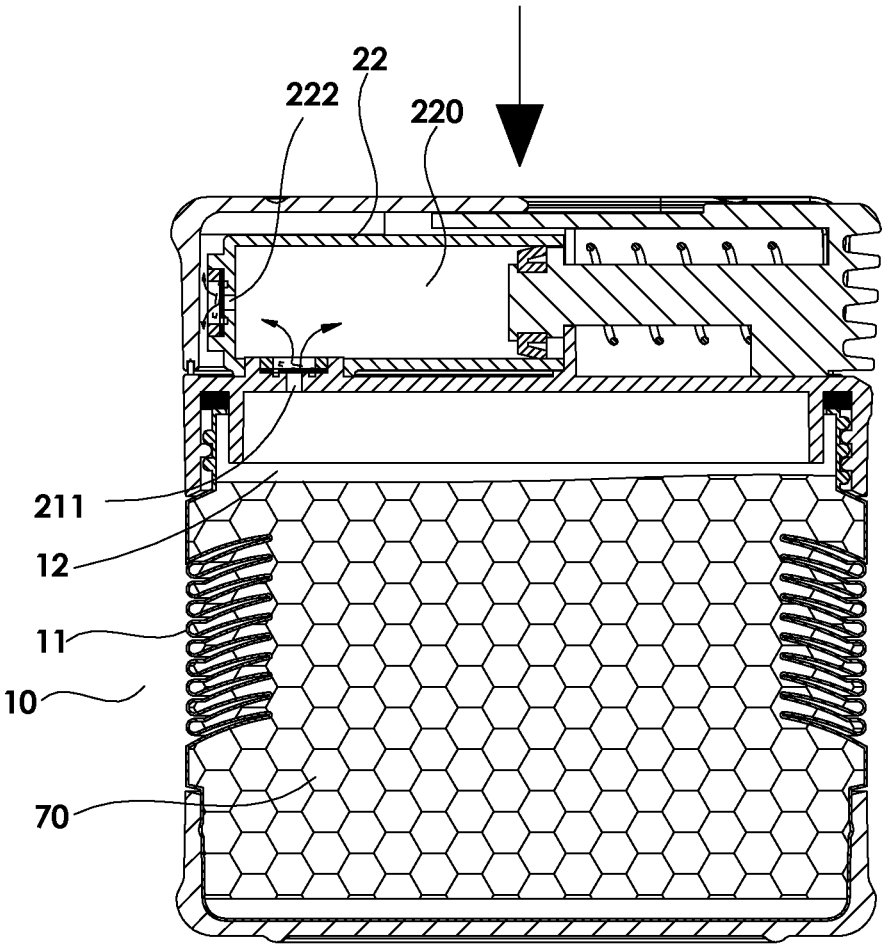
FIG. 6 is a view similar to FIG. 3 showing the receptacle being compressed by exerting a force downward with air being drawn into the cylinder from the receptacle, and air being further expelled out of the cylinder via the open outlet valve.

Alternatively and/or moreover, as shown in FIG. 6, the individual may push down the cover 24 to compress the bellows 11. And in turn, air is drawn into the space 220 of the cylinder 22 from the bellows 11, and air is further expelled out of the cylinder 22 via the open outlet valve 40.

Figure 7A:
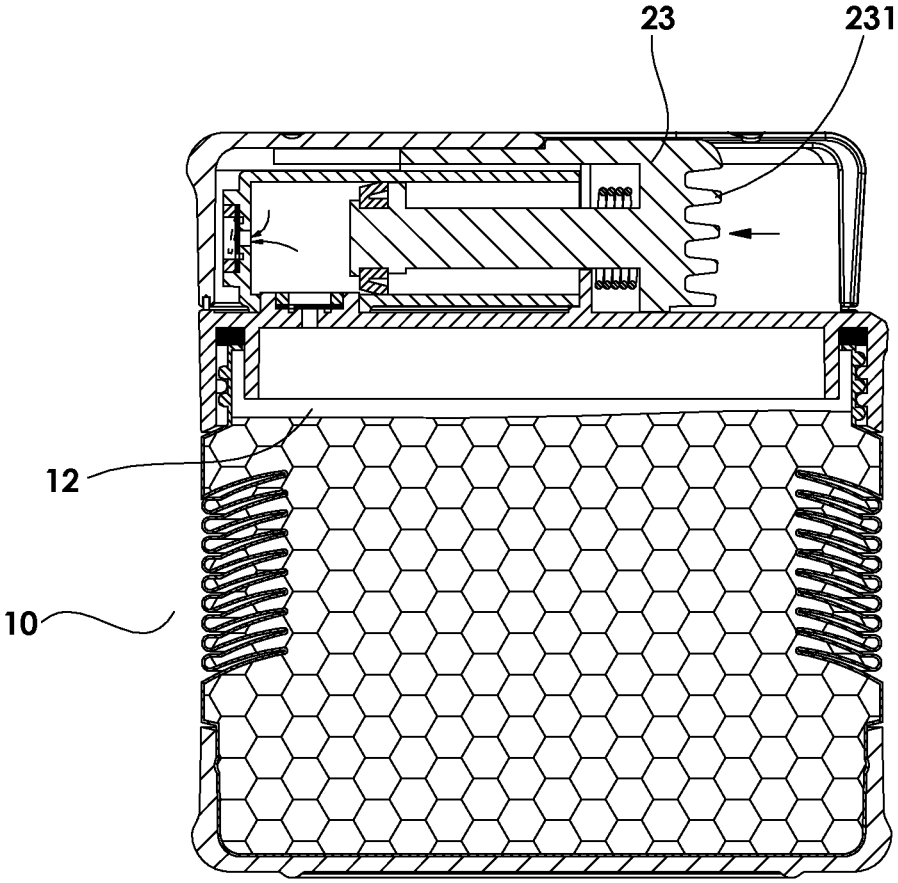
FIG. 7A is a view similar to FIG. 6 further showing the trigger being pressed to expel air out of the cylinder via the open outlet valve.

As shown in FIG. 7A, as a continuing operation of FIG. 6, the individual may further press the trigger 231 to expel air out of the cylinder 22 via the open outlet valve 40 similar to the operation described in FIG. 5A.

Figure 7B:
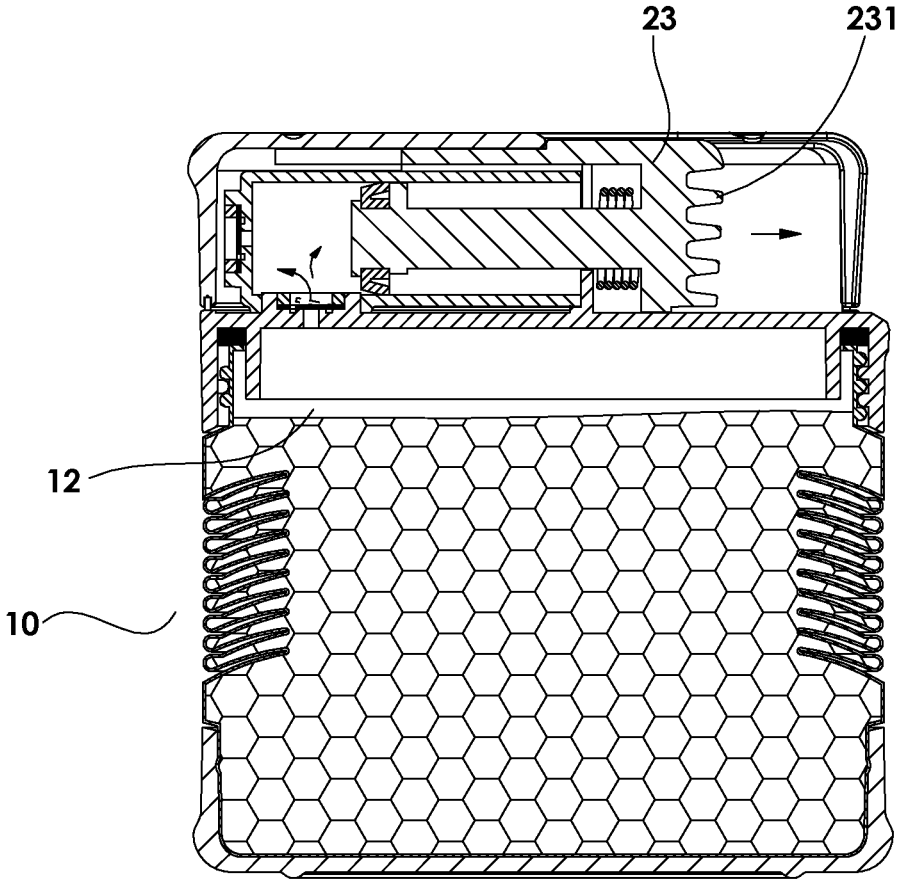
FIG. 7B is a view similar to FIG. 7A further showing after releasing the trigger the trigger being pushed outward by the energized spring to draw air from the receptacle into the cylinder via the open inlet valve.

As shown in FIG. 7B, as a continuing operation of FIG. 7A, after releasing the trigger 231, the trigger 231 is pushed outward by the energized spring 60 to draw air from the bellows 11 into the cylinder 22 via the open inlet valve 30 similar to the operation described in FIG. 5B. Repeated (i.e., reciprocating operations) of FIGS. 7A and 7B can expel most air including moisture out of the cylinder 22 (i.e., being near vacuum), thereby capable of preserving the stored food to a prolonged period of time.

It is envisaged by the invention that most air can be drawn out of the container to create a higher-quality vacuum. The vacuum environment strips bacteria of oxygen needed for survival and slows spoiling.

Although the invention has been described in detail, it is to be understood that this is done by way of illustration only and is not to be taken by way of limitation. The scope of the invention is to be limited only by the appended claims.

What is claimed is:

1. A food storage container comprising:

a receptacle comprising a bellows, an opening formed at one end, and external threads formed around the opening; and a lid comprising:

a peripheral skirt including internal threads secured to the external threads, a bossed hole formed on a top, the bossed hole communicating with the bellows, and a frame formed on the top, the frame having an n-shaped section, the frame including an inner slot;

an inlet valve disposed in the bossed hole;

a trigger assembly including a spring loaded piston disposed in the frame and through the inner slot, and a trigger formed with the spring loaded piston;

a sealing ring secured to an end of the spring loaded piston distal the trigger;

a cylinder for receipt of the sealing ring and a portion of the spring loaded piston, an inlet port fitted on the bossed hole, and an outlet valve disposed at an end distal the sealing ring; and a cover including a peripheral opening for receipt of the trigger;

wherein both the inlet and outlet valves are closed in an inoperative position;

wherein a pushing of the trigger moves the spring loaded piston further into the cylinder to expel air out of the cylinder via the outlet valve;

wherein after releasing the trigger, the trigger is pushed outward to its inoperative position by moving the spring loaded piston to its inoperative position, thereby drawing air from the bellows into the cylinder with the outlet valve being closed; and wherein in response to pushing down the cover, the bellows is compressed, thereby drawing air from the bellows into the cylinder, and expelling air out of the cylinder via the outlet valve.

* * * * *